United States Patent [19]

Cremona

[11] Patent Number: 4,862,600

[45] Date of Patent: Sep. 5, 1989

[54] OPPOSED BELT DRIER FOR WOOD VENEERS

[75] Inventor: Lorenzo Cremona, Monza, Italy

[73] Assignee: Angelo Cremona & Figlio S.p.A., Milan, Italy

[21] Appl. No.: 300,199

[22] Filed: Jan. 23, 1989

Related U.S. Application Data

[63] Continuation of Ser. No. 147,266, Jan. 22, 1988, abandoned.

[30] Foreign Application Priority Data

May 8, 1987 [IT] Italy ..... 20431 A/87

[51] Int. Cl.[4] ..... F26B 13/04

[52] U.S. Cl. ..... 34/117; 34/203

[58] Field of Search ..... 34/114, 116, 155, 159, 34/161, 203, 207, 208, 117, 120

[56] References Cited

U.S. PATENT DOCUMENTS

| | | | |
|---|---|---|---|
| 1,831,911 | 11/1931 | Hetzel | 34/155 |
| 3,733,711 | 5/1973 | Haythornthwaite | 34/155 X |
| 3,896,559 | 7/1975 | Marhn | 34/161 X |
| 4,195,418 | 4/1980 | Sturgeon et al. | 34/155 X |
| 4,486,963 | 12/1984 | Koike et al. | 34/116 |
| 4,654,981 | 4/1987 | Grebe et al. | 34/155 X |

FOREIGN PATENT DOCUMENTS

| | | |
|---|---|---|
| 0152576 | 12/1984 | European Pat. Off. . |
| 1266233 | 10/1968 | Fed. Rep. of Germany . |

*Primary Examiner*—Henry A. Bennet

*Attorney, Agent, or Firm*—Finnegan, Henderson, Farabow, Garrett & Dunner

[57] ABSTRACT

A wood veneer drier in which the veneers are fed between two belts one above the other along a path, which is generally sinusoidal, formed by a plurality of guide rollers around which the said belts partially wind, the said guide rollers being disposed along the generally sinusoidal path followed by the pair of belts. In consequence, the path comprises a plurality of rectilinear sections connected one to the next by very short arcuate sections proximal to the pitch points between the said pair of belts and each guide roller, where each arcuate section preferably subtends an angle of proximately 40°-50°.

6 Claims, 2 Drawing Sheets

OPPOSED BELT DRIER FOR WOOD VENEERS

This application is a continuation of application Ser. No. 147,266, filed Jan. 22, 1988, now abandoned.

BACKGROUND OF THE INVENTION

The present invention relates to a certain number of improvements made to a drier for wood veneers, of the type featuring overlaid belts.

As is known to persons with ordinary skill in the art, wood veneers are dried by the combined effect of pressure and heat inside driers designed for the purpose.

The pressure can be applied either by passing the wood veneers through successive pairs of opposed pressure rollers, which also move the veneers forwards, or by disposing the veneers between two overlaid belts which move along a rectilinear path within the drier.

The driers featuring pressure rollers produce a more pronounced flattening than the belt-type driers.

However, because of the elevated pressures entailed, roller-type driers do not lend themselves satisfactorily to the treatment of thin veneers made from delicate, superior woods. In addition, on account of their scant solidity, the thin veneers have to be guided on their path from one pair of rollers to the next, which fact prevents them from shrinking freely and causes flaws to occur in them.

The driers with overlaid belts, on the other hand, with a simple rectilinear path, have the disadvantage that the weight of the upper belt may not suffice to ensure that the veneers are satisfactorily flattened.

To overcome the aforesaid disadvantage of belt-type driers, it has already been proposed to cause the belts to take a generally sinusoidal path instead of a rectilinear one, and a drier of this type is for example described and illustrated in German patent No. 12 66 233.

As a result of the sinusoidal path they follow, the belts are enabled to bring an adequate flattening pressure onto the veneers; however, such pressure is permanent throughout the drying cycle and does not permit the veneers to shrink freely without risk of causing flaws or cracks.

For the veneers are at every instant obliged to follow a curvilinear path during which they are practically always in contact with the guide rollers on which the overlaid belts containing the veneers wind.

A proposal for overcoming this drawback is contained in European patent No. 0152576, and it provides, between one guide roller and the next -the axes of rotation of which are all in one plane- for a rectilinear section of length equal to at least half of the maximum width of the veneers.

In this manner the veneers follow ample curvilinear sections around the relatively large-diameter guide rollers alternated with rectilinear sections between one guide roller and the next.

Such proposal is not however satisfactory; for if it is true that the veneers are free to shrink in the appropriately sized rectilinear section between one guide roller and the next, in the curvilinear sections having a relatively high width, the pressure brought to bear, at least in respect of certain very thin special and also superior wood veneers, can in any case be such as to cause micro-fissures which cause the surface porosity of the veneers to vary, thus creating problems in the subsequent lacquering operations.

In addition, the arrangement of all the guide rollers in one and the same plane represents a very considerable limitation as regards mounting nozzles able to blow warm air directly onto the veneers contained between the overlaid belts. Because of this, the drying process becomes relatively lengthy, unless costly heating elements are provided within each roller.

The overall object of the present invention is to obviate the aforesaid drawbacks of the known art by embodying a drier for wood veneers, of the type with overlaid belts, in which the path of the belts is such as to allow application of an adequate flattening pressure also to thin, high-quality wood veneers, to allow a shrinkage without fissuring, and to permit a straightforward and economical mounting of nozzles able to blow warm air directly onto the veneers, so as to speed-up the drying process.

SUMMARY OF THE INVENTION

In accordance with the invention, the said object is achieved by a wood veneer drier of the type in which the veneers are moved forward between two overlaid belts along a path, generally sinusoidal, formed by a plurality of guide rollers about which the said belts partially wind, wherein the said guide rollers are disposed along the said generally sinusoidal path followed by the pair of belts, so that the said path comprises a plurality of rectilinear sections connected one to the next by very short arcuate sections proximally to the pitch points between the said pair of belts and each guide roller.

BRIEF DESCRIPTION OF THE DRAWINGS

The structural and functional characteristics of the invention and its advantages over the known art will become more apparent from an examination of the following description, reffered to the appended drawings in which.

DETAILED DESCRIPTION OF THE DRAWINGS

Figure 1:
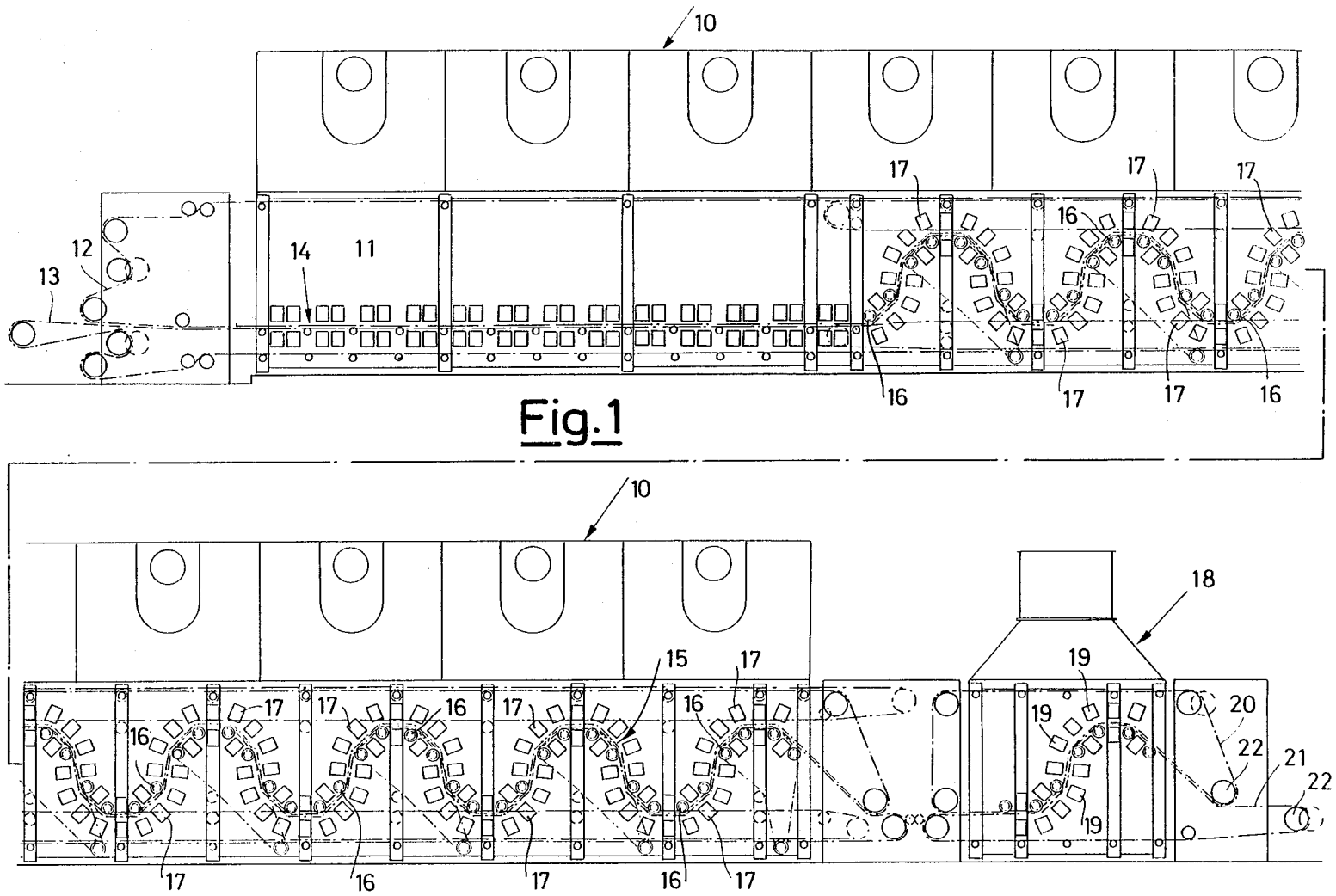
FIG. 1 is a longitudinal section illustrating an example of a drier embodied according to the invention.

With reference to the drawings, the drier in question is indicated overall by 10 and consists structurally of a heated tunnel 11 through which the veneers (not shown) are moved forward between a pair of overlaid conveyor belts 12, 13, upper and lower respectively, each moved continuously along the endless paths shown diagrammatically in FIG. 1 of the drawings. The overlaid conveyor belts 12, 13 can for example consist of metallic nets, and can comprise a first rectilinear section 14 followed by a second generally sinusoidal shaped section 15.

A drier of such type is well-known to persons with ordinary skill in the art and is for example described and illustrated in European patent application No. 0152576.

According to the present invention, instead of being formed as in the known art of a series of some few large-diameter guide rollers all lying in one and the same plane (with the disadvantages previously mentioned), the said sinusoidal path of the overlaid belts is embodied in the form of a plurality of small-diameter rollers 16 which are disposed in different planes, following the same sinusoidal path as the overlaid conveyor belts.

Thus, as is clearly shown in FIG. 1, the sinusoidal path of the belts 12, 13 consists of a broken line comprising a plurality of rectilinear sections connected by very short arcuate sections proximally to the pitch points of the belts vis-à-vis the rollers.

The forward movement of the said belts 12, 13, can be controlled by motorizing either the four rollers at the lower apices or the four rollers at the upper apices of the sinusoid. If necessary, the non-motorized rollers can be adequately frictioned.

It will therefore be evident that, in a drier in accordance with the invention, the disposition of the guide rollers is such as to permit applying to the overlaid belts a tension sufficient to transmit the requisite flattening pressure to the veneers, although with the arcuate path around the said guide rollers minimized, and such as to permit the veneers to shrink even if, during the passage inside the drier, they are always in contact with at least one roller.

The plurality of the curvilinear sections proximal to the pitch points of the guide rollers brings to bear a non-permanent flattening pressure so as to make it possible to regulate shrinkage without causing micro-fissures in the veneers even in the case of very concentrated loads.

In addition, as the travel of the overlaid belts around the guide rollers is minimized, the intackness of the veneers, even if delicate and very thin, is assured. To such end the overlaid belts can on each roller 16 go through an arc subtending an angle of about 40°-50°.

Moreover, with the guide rollers disposed in the manner described it becomes possible to mount on each side of the belts nozzles 17 for blowing warm air directly onto the belts, which cannot be done in the case of driers of known type because of the bulk of the guide rollers all lying in the same plane.

The drier according to the invention also provides, downstream, for a cooling chamber 18 where cold air is blown onto the veneers coming from the drier, through a series of nozzles 19.

Characteristically, within the said chamber 18, the veneers are moved forward along an at least partially sinusoidal path equal to that of the drier. For such purpose the veneers are fed between a pair of overlaid belts 20, 21 guided by guide rollers 22.

It is in this way advantageously assured that the veneers remain in the same condition as when they left the drier.

Figure 2:
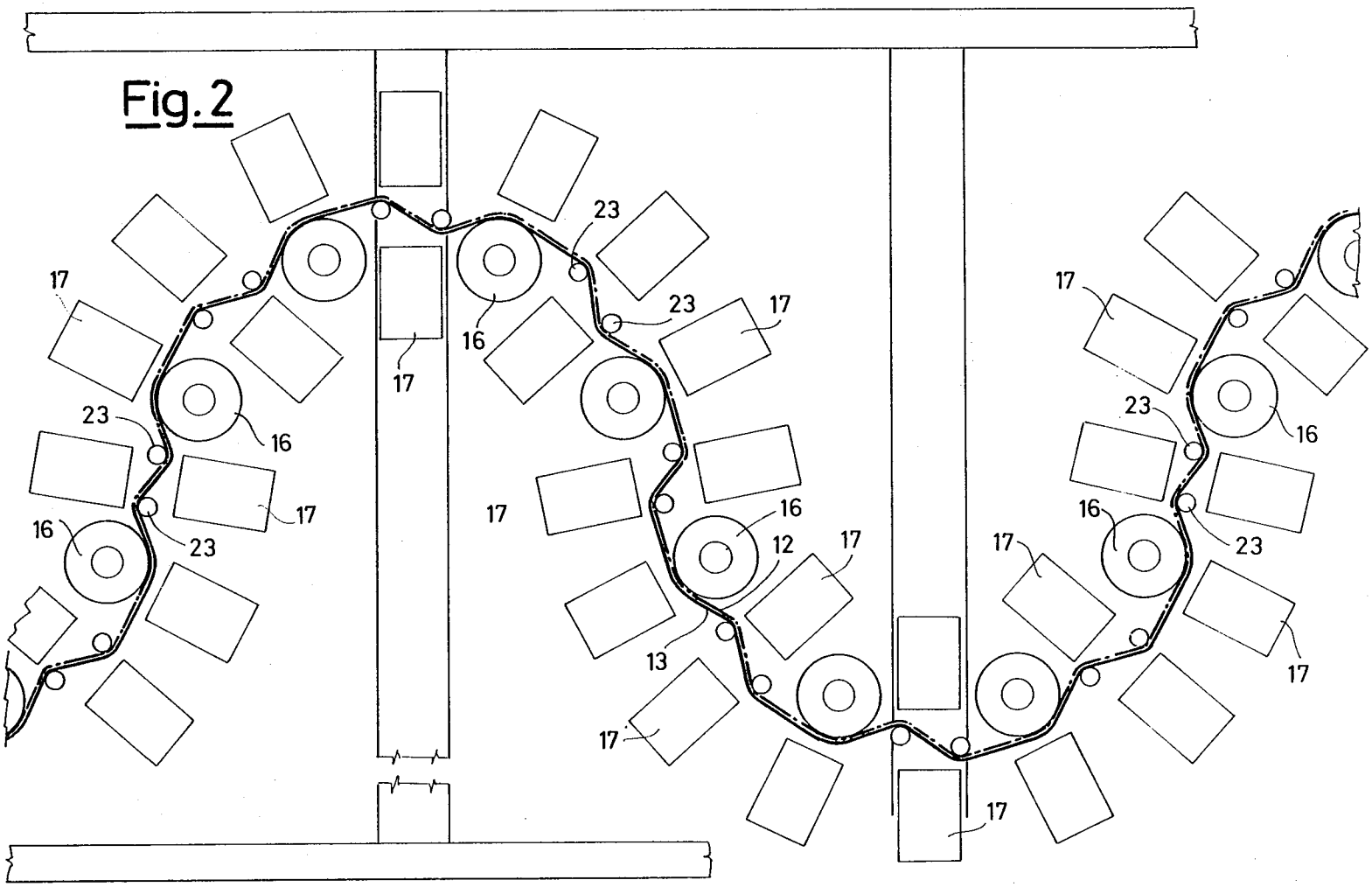
FIG. 2 is an enlarged particular thereof.

As clearly shown in FIG. 2, two further rollers 23 of even smaller diameter can optionally be provided between two guide rollers 16, in order to increase the number of points where a slight pressure is applied to the veneer.

I claim:

1. In an apparatus for drying wood veneers in which the veneers move forward between two overlaid conveyor belts in a heated drier along a generally sinusoidal path formed by a plurality of guide rollers around which said belts partially wrap, the improvement comprising disposing a plurality of guide rollers along and between the upper and lower apices of the sinusoidal path so that the path between each upper and lower apex comprises a plurality of rectilinear sections connected to each other by short arcuate sections of not more than about 50° proximal to the pitch points between the pair of belts and each guide roller.

2. The drier of claim 1, wherein each of the arcuate sections subtend an angle of about 40°-50°.

3. The drier of claim 1, including heaters for blowing warm air directly against both outer sides of the pair of belts in the rectilinear sections between guide rollers along the sinusoidal path.

4. The drier of claim 1, including means for rotating the rollers proximal to the upper and lower apices of the sinusoidal path to cause the belts and veneers to move through the drier.

5. The drier of claim 1, including a cooling chamber downstream of the drier, in which the veneers move between a further pair of belts along a sinusoidal path made up of the same plurality of said guide rollers as in the heated drier.

6. The drier of claim 1, including two additional rollers of smaller diameter than and between each of said guide rollers to increase the number of locations where pressure is applied to the veneers.

* * * * *